US005830534A

United States Patent [19]

Dillon

[11] Patent Number: 5,830,534

[45] **Date of Patent: *Nov. 3, 1998**

[54] METHOD FOR PREPARING DRAW-DOWN SAMPLES

[76] Inventor: Robert L. Dillon, 1128 Harmon Pl. Suite 204, Minneapolis, Minn. 55403

[ * ] Notice: This patent issued on a continued prosecution application filed under 37 CFR 1.53(d), and is subject to the twenty year patent term provisions of 35 U.S.C. 154(a)(2).

[21] Appl. No.: 672,403

[22] Filed: Jun. 28, 1996

Related U.S. Application Data

[60] Provisional application No. 60/000,671 Jun. 30, 1995.

[51] Int. Cl.[6] ..... B05D 3/12

[52] U.S. Cl. ..... 427/277; 118/100; 118/200; 118/256; 15/93.1; 15/236.03; 15/245.1; 15/256.5; 427/286; 427/356; 427/407.1; 427/411

[58] Field of Search ..... 118/100, 200, 118/256; 15/63.1, 236.01, 236.03, 245, 245.1, 256.5, 256.53; 427/277, 286, 356, 407.1, 411, 434.4

[56] References Cited

U.S. PATENT DOCUMENTS

| | | | |
|---|---|---|---|
| 402,859 | 5/1889 | Rose . | |
| 699,370 | 5/1902 | Connor . | |
| 703,319 | 6/1902 | Tallqvist . | |
| 2,081,735 | 5/1937 | Caronia | 15/245.1 |
| 2,151,183 | 3/1939 | Bradley, Jr. et al. | 15/245.1 |
| 3,782,327 | 1/1974 | Wessells et al. | 118/100 |
| 3,832,070 | 8/1974 | Cox . | |
| 4,359,013 | 11/1982 | Prevo | 118/100 |
| 4,494,479 | 1/1985 | Drury et al. | 15/245.1 |
| 4,516,522 | 5/1985 | Drury et al. | 118/100 |
| 4,846,503 | 7/1989 | Strauss . | |
| 4,869,200 | 9/1989 | Euverard | 118/256 |
| 4,909,632 | 3/1990 | McFarlane . | |
| 5,056,826 | 10/1991 | Suwa . | |

OTHER PUBLICATIONS

Opacity Charts, pp. 4–20, No Source Indicated.

BYK Gardner, Catalog 90, pp. 8.1.2–8.1.9.

Opacity Charts, pp. 4–20.

*Primary Examiner*—Peter Chin
*Assistant Examiner*—Michael P. Colaianni
*Attorney, Agent, or Firm*—Merchant, Gould, Smith, Edell, Welter & Schmidt, P.A.

[57] ABSTRACT

A method for preparing draw-down samples of paint using a draw-down applicator is provided. The draw-down applicator comprises a drawing plate having a bottom drawing surface and a bottom fluid delivery surface; a first support or arm having a bottom sliding surface and being rigidly connected to the first drawing plate; and a second support having a bottom sliding surface and being rigidly connected to the drawing plate. The bottom sliding surfaces of said first and second supports form a first plane, and the bottom drawing surface of said drawing plate is in a second plane. The two planes are parallel but not coplanar. Furthermore, the applicator is a non-metallic material. The method includes forming a puddle of paint on a substrate having a substantially smooth surface and drawing the draw-down applicator over the puddle of paint so that the applicator delivers a substantially uniform thickness of the paint over the substrate.

13 Claims, 4 Drawing Sheets

METHOD FOR PREPARING DRAW-DOWN SAMPLES

This application claims priority to provisional application Ser. No. 60/000,671 Jun. 30, 1995.

FIELD OF THE INVENTION

The present invention relates to a draw-down applicator for use in preparing draw-down samples, and more particularly for use in preparing draw-down samples of a coating. The present invention additionally relates to a method and kit for preparing draw-down samples.

BACKGROUND OF THE INVENTION

Paint customers generally select paint based upon relatively small cards having multiple colors. These cards are often referred to as "paint chips." After a paint is purchased and applied to a surface, it is sometimes found that the color of the paint does not match the color of the paint chip because of errors in formulating or mixing the paint. Improperly formulated or mixed paint is frustrating for customers, and returned paint and unsatisfied customers can be bad for a paint store's business. Accordingly, paint samples are often prepared to compare the color of recently mixed paint to the color of paint chips.

Paint samples for comparing recently formulated and mixed paint to a paint chip should be sufficiently large and have a consistent film thickness so that light is properly absorbed and reflected by the sample. Accordingly, a paint brush or a roller should be used to provide a smooth surface and a sufficient thickness of paint. Using a brush or roller, however, is generally too expensive and time consuming since the brush or roller would have to be thrown out or cleaned after each use. High precision film applicators have been used in laboratories to provide coatings having precise thicknesses. For example, see *BYK Gardner Catalog* 90, by BYK-Gardner, Inc., Silver Spring, Md. 20910. These bars, however, are made of steel and require machining to very high tolerances, thereby increasing their expense. In addition, the film applicators are too heavy to be used conveniently, can become misaligned if dropped, and may rust or pit in water or other solvent.

In order to provide a paint sample for comparison, many paint stores provide a "finger smear" of paint on a piece of scrap paper. Generally, a store clerk prepares a finger smear by dipping his finger into a can of paint and smearing the paint onto a piece of scrap paper. The clerk then either wipes off his finger or marks everything he touches with wet paint. Accordingly, a need exists for an inexpensive and convenient alternative device and method for providing samples of paint.

Paint customers often desire to purchase paint which matches paint previously purchased. Many paint stores have a spectrophotometer which measures the light reflected from a sample of the paint, and an accompanying computer calculates the proper mix of pigments to provide a matching paint composition. To provide a sample for the spectrophotometer, a store clerk will prepare a paint sample on a piece of paper. Usually, the paint sample is a finger smear. Since the surface is uneven, the paint does not accurately reflect light and the correct color of the paint is often miscalculated. Since the thickness of the paint prepared by a finger smear is not uniform, thin portions can have insufficient opacity, and thereby allow the substrate color to show through. The thick portions may take some time to dry and may remain wet when handled by the customer.

SUMMARY OF THE INVENTION

A draw-down applicator is provided by the present invention. The draw-down applicator includes a drawing plate, a first support, and a second support. The drawing plate has a bottom drawing surface, a bottom fluid delivery surface, and first and second ends. The first support includes a bottom sliding surface and can be rigidly connected to the first end of the drawing plate. The second support has a bottom sliding surface and can be rigidly connected to the second end of the drawing bar. The bottom sliding surfaces of the first and second supports form a first plane, and the bottom drawing surface of the drawing plate forms a second plane which is parallel but not coplanar with the first plane. In a preferred embodiment of the invention, the first and second supports of the draw-down applicator each have a top sliding surface which forms a third plane; and the drawing plate has a top drawing surface which is in a fourth plane, and a top fluid delivery surface. In this embodiment, the third and fourth planes are parallel but not coplanar.

The applicator is preferably made from a lightweight, non-metallic material resistant to paint solvents. The material can be anything which does not require machining, and which can be molded, preferably by injection molding. Polymeric or plastic materials are preferred. It should be appreciated that the phrase "non-metallic material" is not meant to exclude catalysts or fillers which may contain metal. Rather, it is preferred that the material is one which can be molded rather than machined into a desired shape. Exemplary polymeric materials which can be used in the invention include melt processable thermoplastic materials such as acrylonitrile butadiene-styrene resin, polystyrene, polyamide, polycarbonate, polyester, polyethylene, polypropylene, polyurethane, and mixtures thereof.

In a preferred embodiment, the first plane and the second plane, and the second and third planes, respectively, are separated by a distance which is sufficient to provide a draw-down sample of a desired fluid. If the fluid has a low viscosity, the separation can be small, such as about 1 mil. If the fluid has a high viscosity or if a thick layer of the fluid is desired or if aggregate is included in the fluid, a larger distance may be desired, such as ⅛ inch. It is believed that in most applications involving latex paint as the fluid, the distance will be between about 5 mil and 10 mil.

An advantage of the draw-down applicator of the invention is that it is lightweight and can be conveniently used, for example, by paint store clerks. Generally, the draw-down applicator has a weight of less than about 0.5 pound. More preferably, the weight is less than about 2 ounces, and even more preferably less than about 1 ounce. In order to provide sufficient structure, it may be difficult to provide a draw-down applicator having a weight of less than 0.1 ounce. A draw-down applicator made of acrylonitrile-butadiene-styrene resin and having drawing surfaces of about 2 inches, a drawing plate depth of about 3/16 inch and width of about 15/16 inch, and two legs having lengths of about 1.1 inch and widths of about 15/16 inch has a weight of about 0.5 ounce.

A method for preparing a draw-down sample of a fluid is provided by the present invention. One step in the method includes forming a puddle of fluid on a substrate having a substantially smooth surface and wherein the substrate is separable at a predetermined location into at least two pieces. It should be appreciated that commercially available paper is generally sufficient to provide a substantially smooth surface. Although certain imperfections may be present in the substrate, a more macroscopic view should be used in determining what is "smooth." In addition, separable locations can be provided by perforations, scoring, bending and the like.

Additional steps of the method include providing a draw-down applicator, and drawing the draw-down applicator over the puddle of fluid to provide a sample of the fluid having a substantially uniform thickness. It should be appreciated that a "substantially uniform thickness" describes a layer of fluid which can be provided by the draw-down applicator of the present invention. Generally, it is believed that the sample of fluid having a substantially uniform thickness will be provided on commercially available paper and may have imperfections caused by the texture of the paper.

The method can additionally include a step of removing a dipper from the substrate and using the dipper to scoop the fluid and apply it to the substantially smooth surface. Furthermore, the method can include allowing the drawn fluid to dry, and separating the substrate along a predetermined separable location to provide at least two separated substrates having drawn fluid thereon. It is particularly preferred that the fluid is paint. Alternative fluids, such as, ink, stain, protective finish, and the like, can be used in by the present invention.

A kit for preparing draw-down samples is provided by the present invention. The kit includes a draw-down applicator and a substrate separable at a predetermined location. The substrate is preferably paper which is separable to provide a dipper section and a fluid coatable section. The kit can additionally include a portable smooth and rigid platform which can be used to provide a smooth surface against which the substrate is placed and the draw-down applicator is drawn. Preferably, the kit includes a wash basin for washing the applicator. The wash basin can be a bucket or bowl having sufficient dimensions to hold enough water or other solvent to satisfactorily clean the draw-down applicator after it has been used.

DETAILED DESCRIPTION OF THE INVENTION

Figure 1:
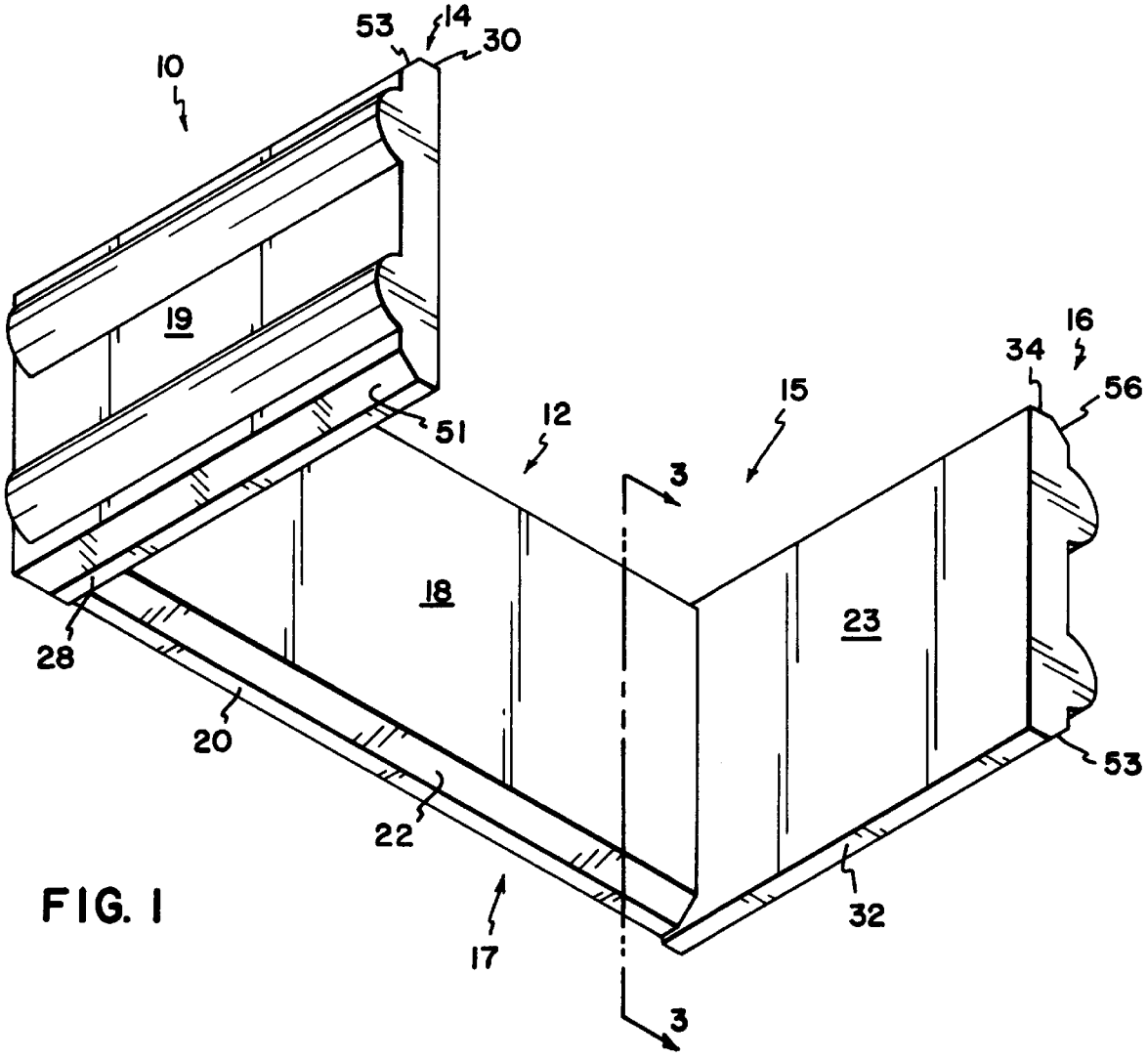
FIG. 1 is a perspective view of a draw-down applicator according to the principles of the present invention.

The preferred embodiment of the invention will be described in detail with reference to the drawings, wherein like reference numerals represent like parts and assemblies throughout the several views. Reference to the preferred embodiment does not limit the scope of the invention, which is limited only by the scope of the claims attached hereto.

Figure 2:
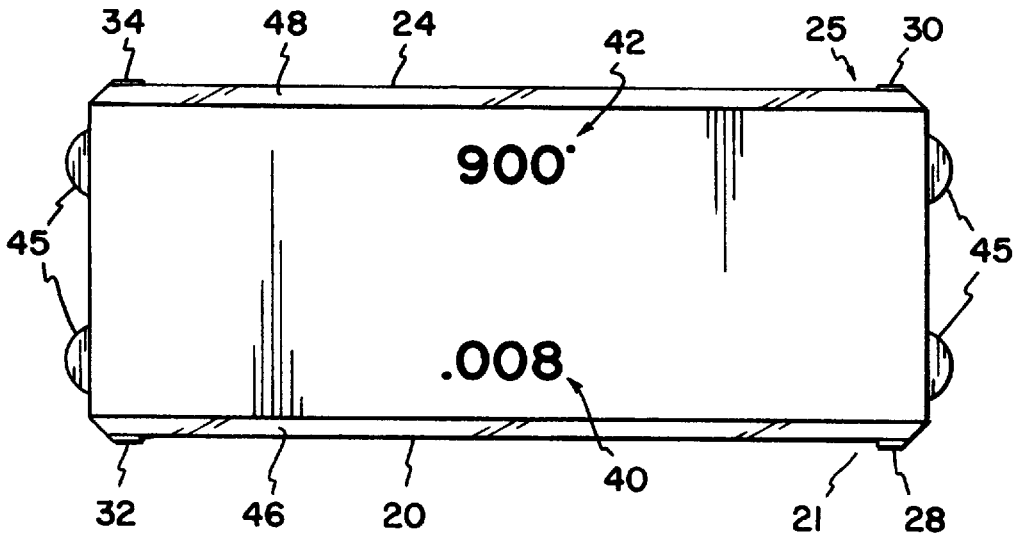
FIG. 2 is a front view of the draw-down applicator of FIG. 1.
Figure 3:
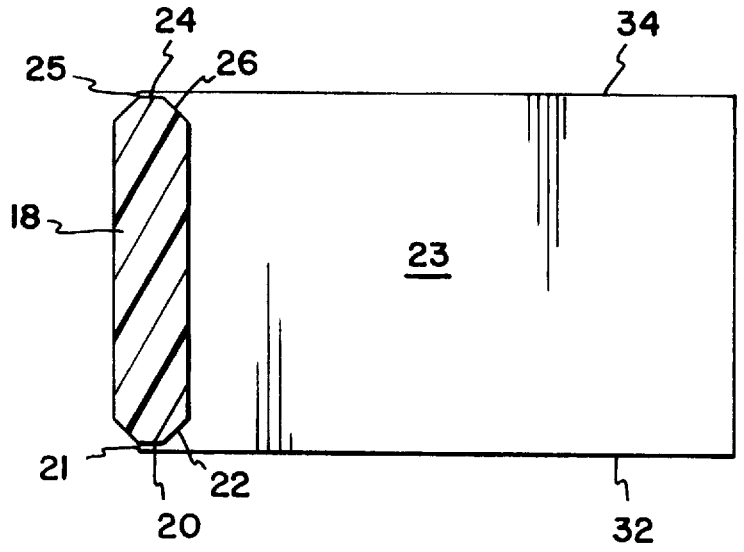
FIG. 3 is cross sectional view taken along line 3—3 of the draw-down applicator of FIG. 1.

Referring to FIGS. 1–3, an embodiment of a draw-down applicator of the present invention is provided at 10, and may be referred to as the applicator. The draw-down applicator 10 includes drawing region 12, first guiding region 14, and second guiding region 16. Preferably, the applicator 10 is an integral piece. It is to be understood that the word "integral" refers to the draw-down applicator 10 being a continuous material which does not separate into subparts except by fracturing. Alternatively, the applicator can be made of parts which snap together to provide an assembled applicator.

The drawing region 12 includes a drawing plate 18 having a bottom drawing surface 20 and a bottom fluid delivery surface 22, and a top drawing surface 24 and a top fluid delivery surface 26. As a matter of convenience, one side of the applicator 10 can be referred to as the top side 15 and the opposed side can be referred to as the bottom side 17. It should be appreciated that the designation of "top" and "bottom" reflects opposed surfaces or sides of the applicator 10. Since the applicator 10 is so small and lightweight, it can easily be turned over so that the bottom side 17 is above or "on top of" the top side 15.

As will be described in more detail, the fluid delivery surfaces 22, 26 are provided to meter or control the flow of fluid to the drawing surfaces 20, 24 to form a thin film of fluid on a substrate when the applicator 10 is drawn over a puddle of fluid. Accordingly, the angle of the fluid delivery surfaces 22, 26 to the drawing surfaces 20, 24 is provided based upon intended flow properties. One having skill in the art would readily appreciate how fluid rheology effects these angles. For many latex paints, it is acceptable to provide a 45 degree angle as shown.

The first guiding region 14 includes a first leg 19 having a bottom sliding surface 28 and a top sliding surface 30. Similarly, the second guiding region 16 includes a second leg 23 having a bottom sliding surface 32 and a top sliding surface 34.

The bottom drawing surface 20 lies in a bottom drawing plane which is parallel to the bottom sliding plane formed by the bottom sliding surfaces 28, 32. Similarly, the top drawing surface 24 lies in a top drawing plane which is parallel to the top sliding plane formed by the top sliding surfaces 30, 34. It should be understood that the bottom drawing surface need not entirely be within the bottom drawing plane, and that the top drawing surface need not entirely be within the top drawing plane. In other words, the drawing surfaces can be provided at any desired angle to the sliding surfaces. However, the bottom drawing plane is not coplanar with the bottom sliding plane, and the top drawing plane is not coplanar with the top sliding plane. It is the discontinuity between these plane, or expressed differently, it is the discontinuity along the surfaces 28, 20, 32 and along the surfaces 30, 24, 34 which is important for providing slots 21, 25, respectively, which allow the draw-down applicator 10 to provide draw-down samples as will be described in more detail. The slots 21, 25 are provided with sufficient depth to provide a desired thickness of fluid to flow therethrough. Preferably, the coating provided by the applicator has a substantially uniform thickness on a substrate. It is to be understood that a "substantially uniform thickness" is meant to include a coating on paper where the coating can have irregularities due to pores or fibers therein.

For applicator 10, as an example, the distance between the bottom drawing plane and the bottom sliding plane is 8/1000 inch (8 mils) and is indicated by the raised markings 40 on the front of the drawing plate 18. The distance between the top drawing plane and the top sliding plane is 6/1000 inch (6 mils) and is indicated by the raised markings 42. It has been found that for most commercially available paints, these slot sizes are sufficient for providing adequate draw-down samples. For most applications, the slot depth should be above about 1 mil and less than about 10 mil. However, alternative slot sizes can be provided depending, for example, on the viscosity of the fluid and the desired thickness of the coating.

The beveled surfaces 46, 48, 51, 53, 55, 56 are provided to reduce the angle of the edges and to reduce the amount of material used to prepare the applicator 10. This additionally keeps the applicator lighter in weight. In addition, the beveled surfaces 51, 53, 55, 56 help reduce the surface area of the sliding surfaces 28, 30, 32, 34 which helps reduce friction and allows the applicator 10 to slide or glide more easily over the surface of a substrate.

When the applicator 10 is used to provide a draw-down sample, either the top side 15 or the bottom side 17 is slid across the surface of a substrate. Preferably, the surface of the substrate is a substantially smooth surface. As used herein, a "substantially smooth surface" is a surface which is sufficiently even and uniform to provide a draw-down sample having a relatively consistent coating or film thickness using the draw-down applicator of the present invention. Generally, commercially available paper would be capable of providing a substantially smooth surface. To help provide a substantially smooth surface, a smooth and rigid platform can be placed under the substrate. Exemplary platforms include fixed or relatively immovable objects such as tables, counters, desks, and the like, or portable objects such as glass or metal plates, plexiglass, fiberglass, or other plastic sheet, and the like.

Figure 4:
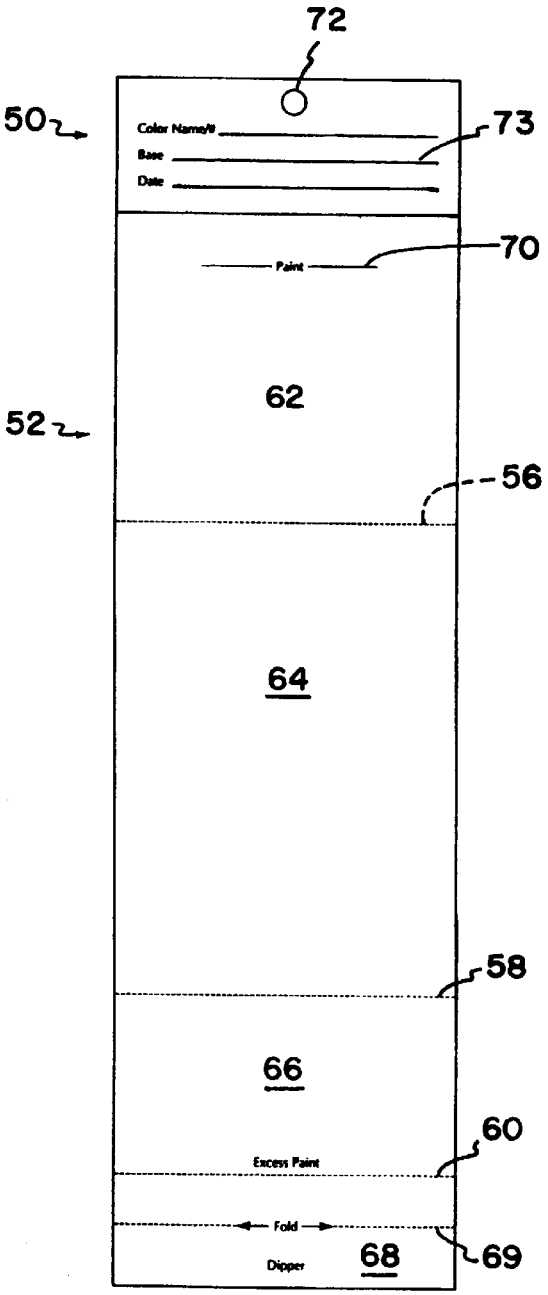
FIG. 4 is a top view of a draw-down card according to the principles of the present invention.
Figure 5:
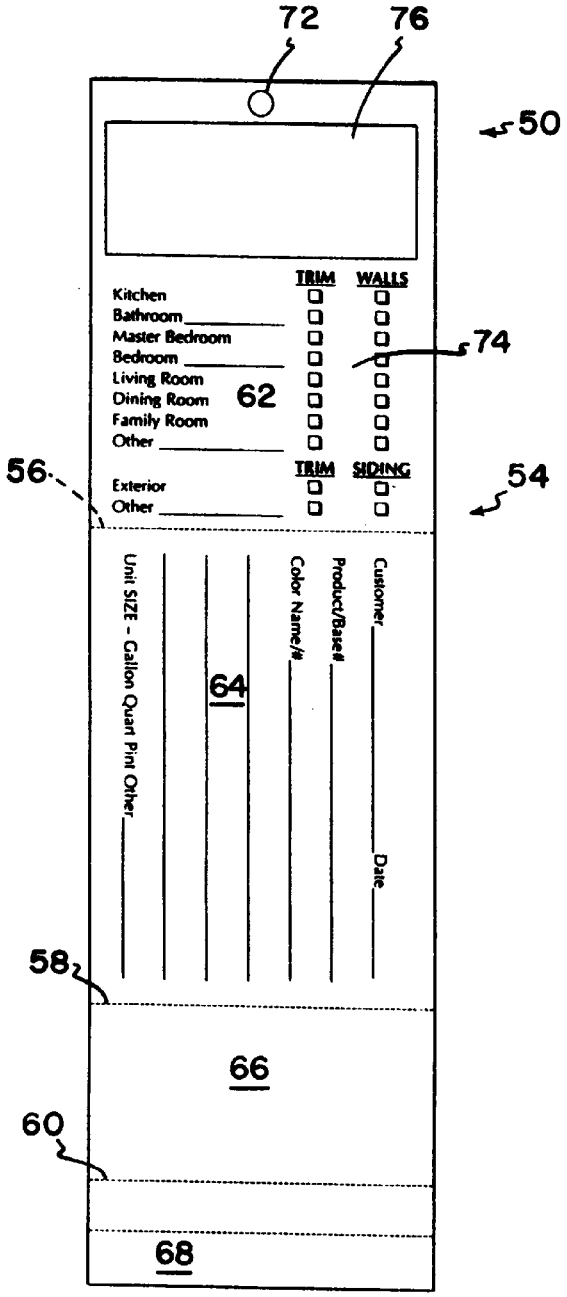
FIG. 5 is a bottom view of the draw-down card shown in FIG. 4.

A substrate which can be used to provide a draw-down sample according to the present invention is provided in FIGS. 4 and 5, and is referred to as draw-down card 50. The draw-down card 50 has a first side 52 and a second side 54. The draw-down card 50 includes perforations 56, 58, 60 which allow for separation of portions of the card into take home section 62, retention section 64, excess paint section 66, and a dipper section 68. It is preferred to provide a draw-down sample across the first side of the take home section 62 and the retention section 64. It is noted that in place of the perforations, the card can have slits, scoring, indentations, markings, and the like which identify a suitable area for separation by, for example, tearing, cutting, etc.

In a preferred embodiment for providing a draw-down sample of latex paint, the dipper section 68 is removed and folded along score line 69 to provide a V-shaped dipper. The remaining part of the card 50 can be placed on a flat and level surface with the first side up. The dipper can be dipped into the paint, and the paint in the dipper can be applied over the paint application line 70 to substantially cover the line and form a puddle of paint. It should be appreciated that the size of the line 70 can be used to indicate a predetermined sufficient amount of paint needed to provide an acceptable draw-down sample. Once the paint has been applied, the dipper can be thrown away.

Figure 6:
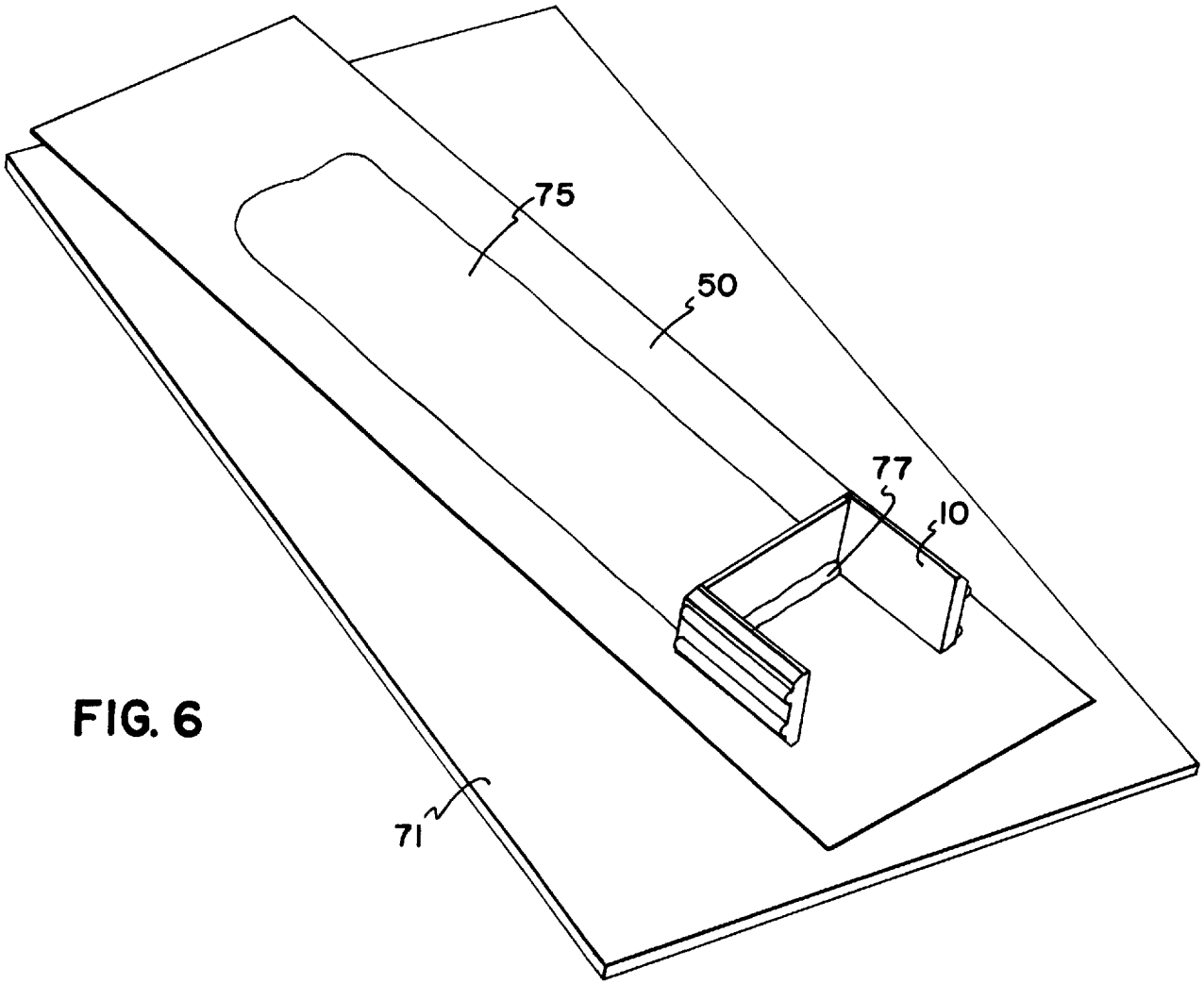
FIG. 6 is a perspective view, in operation, of a kit for preparing a draw-down sample.

The draw-down applicator 10 can be placed around the puddle of paint so that either the bottom sliding surfaces 28, 32 or the top sliding surfaces 30, 34 are resting on the first surface of the draw-down card 50. Thus, the legs 19, 23 are positioned around the puddle so that the drawing plate 18 is ready to engage the puddle once the applicator 10 is drawn thereover. If the bottom side of the applicator 10 is placed on the card 50, once the card is drawn, the fluid flows over the bottom fluid delivery surface 22 so that the bottom drawing surface 20 provides a coating having a consistent thickness on the card. Once the drawing plate 18 engages the puddle of fluid, the tendency of the fluid would be to spread out. The legs 19, 23, however, typically contain the fluid within the applicator 10 so that a draw-down sample having a width which is equal to the distance between the legs 19, 23 is provided. In a substantially continuous motion, the applicator 10 draws the puddle of paint over the sections 62, 64, 66. An embodiment showing the end of this drawing stage is provided in FIG. 6 showing plexiglass platform 71, draw-down sample 75, and puddle of excess paint 77.

Once the draw-down sample 75 is completed, the draw-down applicator 10 can be placed in a wash-up bin or bucket filled with cleaning solution such as water or turpentine, and the excess paint section 66 can be removed along perforation 58 from the card 50 and discarded. The remaining sections 62, 64 can be hung on a hook via hole 72 until the paint dries. It is an advantage of the present invention that the applicator 10 can be easily cleaned since the surfaces are relatively smooth. Alternatively, the applicator 10 is sufficiently inexpensive that it can be disposed or recycled. Furthermore, it is an advantage that draw-down samples can be prepared without creating a mess and without requiring hand cleaning afterwards. The dipper 68 and the excess paint section 66 containing the puddle of excess paint 77 are discarded. It is another advantage that the draw-down card 50 containing a wet draw-down sample 75 can be hung in an out of the way place until the sample dries. Accordingly, the present invention provides for increased organization in preparing draw-down samples.

The card 50 can include additional information. For example, the first side of the take home section 62 includes an area for identifying the paint 73, and the second side of the take home section 62 includes an area for identifying the application of the paint 74 and an area for identifying the paint store 76. The second side of the retention section 64 includes an area for identifying the customer and the paint. The take home section 62 can be kept by the customer and the retention section 64 can be kept by the paint store for its records.

It should be appreciated that the draw-down card can be modified to provide any information desired. In addition, multiple draw-down cards can be prepared. For example, it may be desirable for architects or contractors to provide draw-down samples to clients along with plans. In such cases, it may be helpful to prepared additional draw-down samples for the store's records, for the architect's records, and for the client's records. Alternatively, the card can be modified to be used in other applications, such as in a laboratory. In such an application, for example, it may be desired to provide only two perforated line, one for separation of the dipper and one for separation of the excess paint section.

It is an advantage of the present invention that relatively large samples of paint, or large paint chips, can be inexpensively and conveniently prepared and taken home by paint customers for evaluation. It is understood that paint often looks different in various lighting conditions, and/or when applied to a large surface. It is believed that by providing large samples of paint for customers to evaluate, customer satisfaction with selected paints will increase. Accordingly, the size of the applicator can be modified to provide a desired size draw-down sample. It is preferred that the width of the substrate on which the draw-down sample is prepared is larger than the overall width of the draw-down applicator. This helps provide a substantially consistent film thickness.

It is an additional advantage of the present invention that the draw-down applicator can be easily and inexpensively prepared, and can provide desired accuracy in preparing a draw-down sample. As discussed above, high precision film applicators have been used in laboratories to provide coatings having precise thicknesses. These bars, however, are heavy and expensive. The applicator of the invention provides significantly low distribution costs due to its light weight. In addition, it is an advantage of the present invention that the draw-down applicator is light and easy to use, inexpensive to manufacture, and resists corrosion and pitting in water and many solvents commonly used in coating compositions. In addition, the draw-down applicator is sufficiently rigid to resist bending out of shape if dropped.

It should be appreciated that many types of fluid can be used with the draw-down applicator and/or the draw-down card of the present invention. Preferably, the fluid is a type which provides a coating on a substrate. Exemplary fluids include paints such as latex and oil based paints, and consumer and industrial paints, finishes such as polyurethane and polyacrylic finishes, stains, and the like. A preferred fluid which can be used to provide a draw-down sample is latex paint since the draw-down applicator can be easily cleaned in water afterwards.

The applicator 10 can generally be used on a level or tilted surface. It is desirable, however, that the surface is sufficiently level so as to resist the flow of fluid in any one direction caused by the force of gravity. It is understood that when a fluid is applied to a perfectly level surface, it theoretically will flow in all directions equally. It is desirable, however, that the draw-down applicator provides the force which displaces the fluid to provide the draw-down sample.

It should be appreciated that the ability of a fluid to flow is a function of viscosity, and that certain paint compositions are intended to be applied to vertical walls. Thus, the degree of tilt or slant of the substrate is a function of the rheology of the paint composition. For example, if a paint if very viscous, it will resist flow caused by gravity. In contrast, a very low viscosity fluid may exhibit runny characteristics. It is generally desirable that when a paint composition is applied to the substrate, it remains in a puddle and does not flow until drawn by the applicator 10.

The draw-down applicator of the present invention can be manufactured without machining. Preferably, the draw-down applicator is prepared, for example, by injection molding or compression molding. Materials which can be used to prepare the draw-down applicator are preferably polymeric materials resistant to solvents normally found in paint composition, and which are melt processable thermoplastics. Exemplary polymeric materials include acrylonitrile-butadiene-styrene (ABS) resin, polystyrene, polyamide, polycarbonate, polyester, polyethylene, polypropylene, polyurethane, mixtures thereof and the like.

When preparing the draw-down applicator by injection molding, it is desirable for the walls to be as thin as possible to decrease manufacturing time, yet sufficiently thick to provide desired stability. Thicker walls generally take longer to cool before they can be removed from a mold. Preferably, the wall thickness should be in the range of about ¼ to 1/16 inch. In order to decrease the wall thickness and provide a sufficiently high manufacturing rate, the first and second legs 19, 23 of the applicator 10 are provided with stabilizers 45 which allow the applicator 10 to be more quickly removed from an injection mold. The stabilizers 45 have a sufficient diameter which allow injector pins to push against the ends thereof to push the applicator out of the mold. Thus, as the diameter of the stabilizers 45 decreases, the time need to cure or solidify before removal from the mold increases. Generally, a diameter in the range of about ¼ to ⅛ inch is sufficient to provide a desired manufacturing rate. The stabilizers 45 may additionally help reduce warping or bending of the legs. Unless the sliding surfaces are in one plane, the thickness of a film prepared by the applicator may not be sufficiently even. It is believed that warping may increase over time without the stabilizers. In addition, it is believed that the stabilizers may help increase heat transfer thereby decreasing the time to make the applicator. Advantageously, the stabilizers help provide a gripping surface on the sides of the legs when pulling the applicator across a substrate.

It should be appreciated that the draw-down applicator and the draw-down card of the present invention can be useful for applications outside of a paint store environment. For example, they can be useful in laboratories, graphic arts applications, and the like.

A preferred material for use as the substrate includes 10 point paper coated one side cast coat paper.

One commercially available paper stock is CROMECOTE 2000 sold by Champion Paper. It is preferable to provide the draw-down sample on the side of the paper coated with a high gloss coating and provide written information on the uncoated side. It should be kept in mind, however, that uncoated paper can also be used, including any other substrate which is capable of receiving a coating by the draw-down applicator of the present invention.

While the invention has been described in conjunction with specific embodiments thereof, it is evident that different alternatives, modifications, variations, and uses will be apparent to those skilled in the art in view of the foregoing description. Accordingly, the invention is not limited to these embodiments or the use of elements having specific configurations and shapes as presented herein.

What is claimed is:

1. A method for preparing a draw-down sample of a paint, comprising:

(a) forming a puddle of paint on a substrate having a substantially smooth surface;

(b) providing a draw-down applicator comprising:

i) drawing plate having a drawing surface, a fluid delivery surface, and first and second ends;

(ii) first support having a sliding surface and being rigidly connected to the first end of said drawing plate; and (iii) second support having a sliding surface and being rigidly connected to the second end of said drawing plate, wherein the sliding surfaces of said first and second supports form a first plane, the drawing surface of said drawing plate is in a second plane which is parallel but not coplanar with the first plane, the first plane and the second plane are separated by a distance of greater than about 0.001 inches, and said applicator is made from a non-metallic material; and (c) drawing the draw-down applicator over the puddle of paint so that the fluid delivery surface delivers the paint to the drawing surface to provide a sample of the paint having a substantially uniform thickness.

2. A method for preparing a draw-down sample according to claim 1, wherein the substrate comprises a perforation for separation.

3. A method for preparing a draw-down sample of a paint according to claim 1, wherein said step of forming a puddle of paint on a substrate further comprises removing a dipper from the substrate and using the dipper to scoop the paint and applying it to the substantially smooth surface.

4. A method for preparing a draw-down sample of a paint according to claim 1, further comprising:

(d) allowing the drawn paint to dry; and (e) separating the substrate along a predetermined separable location to provide at least two separated substrates having drawn paint thereon.

5. A method for preparing a draw-down sample according to claim 1, wherein the drawing surface has a length of between about 1 and 3 inches.

6. A method for preparing a draw-down sample according to claim 1, wherein said applicator is molded.

7. A method for preparing a draw-down sample according to claim 1, wherein the paint delivery surface comprises a bevel for providing fluid substantially evenly across the drawing surface.

8. A method for preparing a draw-down sample according to claim 1, wherein said applicator is an integral piece formed from polymeric material resistant to paint solvents.

9. A method for preparing a draw-down sample according to claim 8, wherein said polymeric material is selected from the group consisting of acrylonitrile-butadiene-styrene resin, polystyrene, polyamide, polycarbonate, polyester, polyethylene, polypropylene, polyurethane, and mixtures thereof.

10. A method for preparing a draw-down sample according to claim 1, wherein said draw-down applicator weights less than about 0.5 pounds.

11. A method for preparing a draw-down sample according to claim 1, wherein the substrate comprises paper.

12. A method for preparing a draw-down sample according to claim 1, wherein the substrate comprises paper having a high-gloss coating.

13. A method for preparing a draw-down sample of a paint, comprising:

(a) forming a puddle of paint on a substrate having a substantially smooth surface, wherein the substrate comprises a perforation for separation into at least two pieces;

(b) providing a draw-down applicator comprising:

i) drawing plate having a drawing surface, a fluid delivery surface, and first and second ends;

(ii) first support having a sliding surface and being rigidly connected to the first end of said drawing plate; and (iii) second support having a sliding surface and being rigidly connected to the second end of said drawing plate, wherein the sliding surfaces of said first and second supports form a first plane, the drawing surface of said drawing plate is in a second plane which is parallel but not coplanar with the first plane, the first plane and the second plane are separated by a distance of greater than about 0.001 inches; and (c) drawing the draw-down applicator over the puddle of paint so that the fluid delivery surface delivers the paint to the drawing surface to provide a sample of the paint having a substantially uniform thickness.

* * * * *